US007752722B2

(12) United States Patent
Calkin

(10) Patent No.: US 7,752,722 B2
(45) Date of Patent: Jul. 13, 2010

(54) ADJUSTABLE LENGTH LITTER STRAP ASSEMBLY

(75) Inventor: Carston R. Calkin, Tualatin, OR (US)

(73) Assignee: Skedco, Inc., Tualatin, OR (US)

( * ) Notice: Subject to any disclaimer, the term of this patent is extended or adjusted under 35 U.S.C. 154(b) by 524 days.

(21) Appl. No.: 11/615,952

(22) Filed: Dec. 23, 2006

(65) Prior Publication Data

US 2008/0148533 A1 Jun. 26, 2008

(51) Int. Cl.
*A44B 11/00* (2006.01)

(52) U.S. Cl. ..... 24/632; 128/876; 24/265 BC; 5/628

(58) Field of Classification Search ..... None
See application file for complete search history.

(56) References Cited

U.S. PATENT DOCUMENTS

| | | | | |
|---|---|---|---|---|
| 3,046,982 | A | 7/1962 | Davis | |
| 3,486,672 | A * | 12/1969 | Esopi | 280/814 |
| 3,893,210 | A * | 7/1975 | Hildebrandt | 24/194 |
| 4,149,540 | A | 4/1979 | Hasslinger | |
| 4,729,591 | A * | 3/1988 | Scalise | 294/141 |
| 5,388,274 | A * | 2/1995 | Glover et al. | 2/338 |
| 5,729,877 | A | 3/1998 | Kong et al. | |
| 5,802,756 | A | 9/1998 | Hightower | |
| 5,918,785 | A | 7/1999 | Irose | |
| 5,971,947 | A | 10/1999 | McNally et al. | |
| 6,073,280 | A * | 6/2000 | Farnum | 5/89.1 |
| 6,318,612 | B1 * | 11/2001 | MacNeil | 224/572 |
| 6,363,936 | B1 | 4/2002 | McCormick et al. | |
| 6,687,964 | B2 | 2/2004 | Vanderpool | |
| 6,772,485 | B2 | 8/2004 | Alpert | |
| 2002/0083562 | A1 | 7/2002 | Lerra | |
| 2005/0240217 | A1 | 10/2005 | Jennifer et al. | |

* cited by examiner

*Primary Examiner*—Jack W. Lavinder
(74) *Attorney, Agent, or Firm*—Stoel Rives LLP

(57) ABSTRACT

A litter strap that is easily adjustable to any length while simultaneously secure under tension includes an elongate strap extending between first and second parts of a two-piece buckle. The strap may be threaded through one of the buckle parts and manually slidable therethrough for adjusting a length of the litter strap assembly. A flexible pinch guard may be affixed to the strap so that the pinch guard substantially overlaps the first buckle part when the buckle parts are decoupled and may be wider than the strap and sized to substantially overlap the first and second buckle parts when the buckle parts are coupled. A keeper loop may encircle a middle portion of the strap and be slidable therealong and a pull tab may extend from the keeper loop to facilitate adjusting a position of the keeper loop along the middle portion.

36 Claims, 3 Drawing Sheets

ADJUSTABLE LENGTH LITTER STRAP ASSEMBLY

BACKGROUND

This disclosure relates to adjustable securement straps, such as a strap for use with a litter, stretcher, gurney or the like that is easily adjustable to any length while simultaneously secure at that length so the strap may accommodate people of all shapes and sizes.

Transporting an incapacitated or injured person from an emergency situation, such as an accident site or battlefield, to a hospital or other place for treatment is essential to receiving proper medical care. An ambulance, such as a van, truck, helicopter or similar vehicle, is well known for such transport. However, the patient or injured person must first be moved from their initial location to the ambulance. Litters, stretchers, and similar devices are known to facilitate such casualty movement. To prevent further injury, straps are generally used to immobilize the person during transport, as described, for example, in U.S. Pat. No. 3,046,982 of Davis which discloses a safety belt and harness for confining a person to a litter. Straps may also be used to secure the person and the litter to a bed or support structure in the transport vehicle.

The present inventor has recognized a need for improved securement straps including features useful for patient transport.

SUMMARY

An adjustable length litter strap assembly comprises an elongate strap extending between first and second parts of a two-piece buckle to form a securement loop. The strap is threaded through one of the buckle parts and manually slidable therethrough for adjusting a length of the litter strap assembly. According to one embodiment, a pinch guard is affixed to a first end portion of the strap so that the pinch guard substantially overlaps the first buckle part when the first buckle part is detached from the second buckle part. The pinch guard preferably has a width greater than a width of the strap and is sized to substantially overlap the first buckle part and second buckle part when the first buckle part is attached to the second buckle part.

According to another embodiment, a free end of the strap is secured to a keeper loop that encircles a middle portion of the strap at a section thereof between the first and second buckle parts and is slidable therealong. The free end portion of the strap is preferably folded upon itself to define a pull tab that extends from the keeper loop to facilitate grasping for adjusting a position of the keeper loop along the middle portion.

Additional aspects and advantages will be apparent from the following detailed description of preferred embodiments, which proceeds with reference to the accompanying drawings.

DETAILED DESCRIPTION OF PREFERRED EMBODIMENTS

Figure 1:
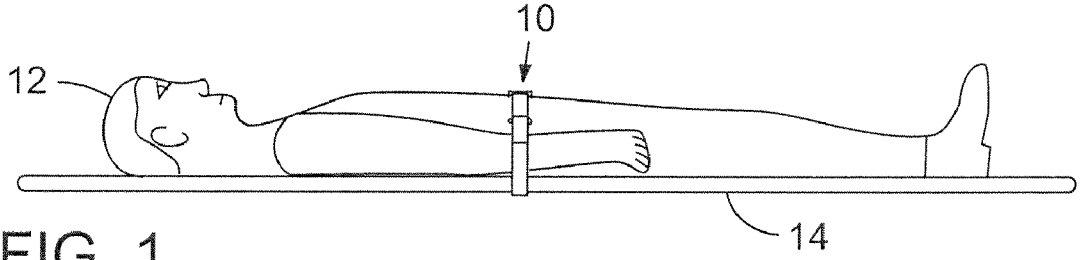
FIG. 1 is a side view of a person secured to a litter with a litter strap assembly according to a preferred embodiment.
Figure 2:
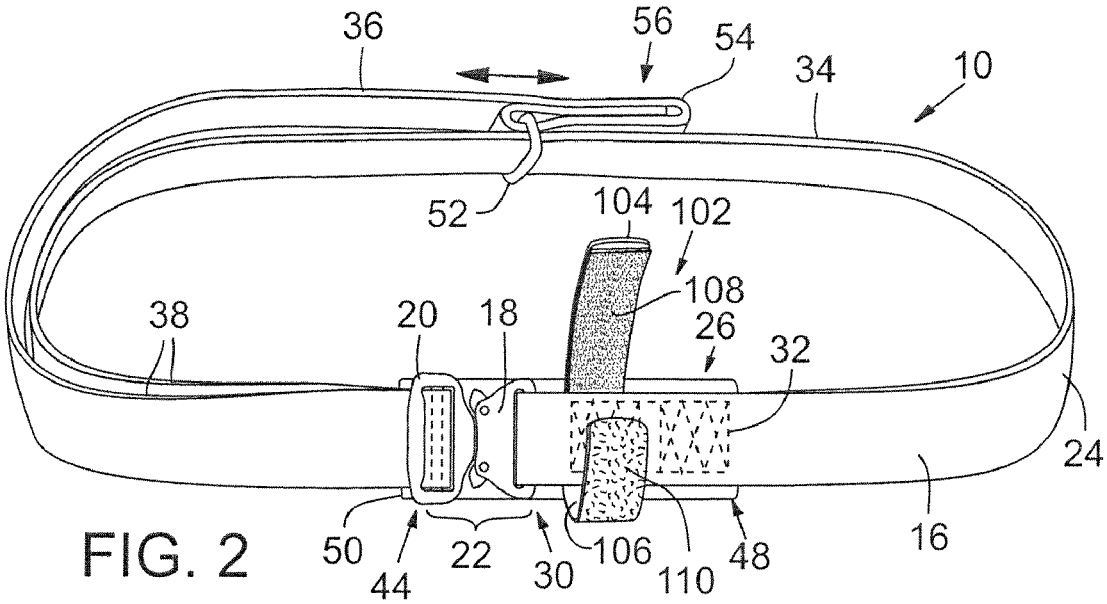
FIG. 2 is a pictorial view of the litter strap assembly of FIG. 1.
Figure 3:
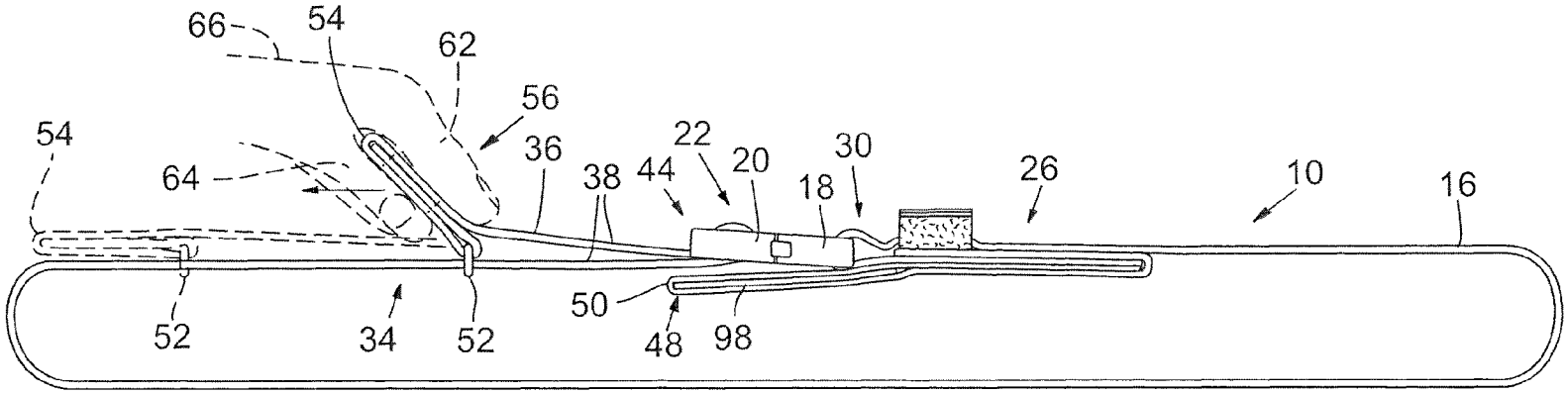
FIG. 3 is a side view of the litter strap assembly of FIG. 2 showing the litter strap assembly being adjusted to a smaller size.

FIG. 1 illustrates a litter strap assembly 10 being used to secure a person 12 to a litter 14. FIGS. 2 and 3 are enlarged pictorial and side views, respectively, of litter strap assembly 10. With reference to FIGS. 2 and 3, litter strap assembly 10 includes an elongate strap 16 extending between mating first and second buckle parts 18, 20 of a two-piece buckle 22 to form a securement loop 24 for encircling and securing around a person or other object. Strap 16 is preferably made of a continuous elongate strip of fabric, such as woven nylon webbing, although other materials may also be suitable. A first end portion 26 of strap 16 is preferably securely attached to first buckle part 18 by threading through an elongate slot 28 of first buckle part 18 and folding first end portion 26 upon itself to form an overfolded first end section 30 that is secured to itself by stitching 32 or otherwise. In other embodiments (not shown), first end section 30 may be securely connected to first buckle part 18 by other means, such as riveting, stitching, overmolding, heat welding, bonding or otherwise.

Figure 4:
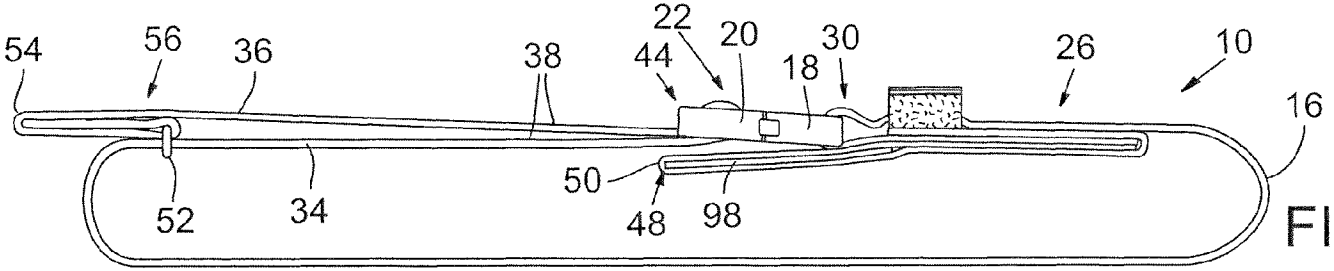
FIG. 4 is an auxiliary side view of the adjusted litter strap assembly of FIG. 3.
Figure 5:
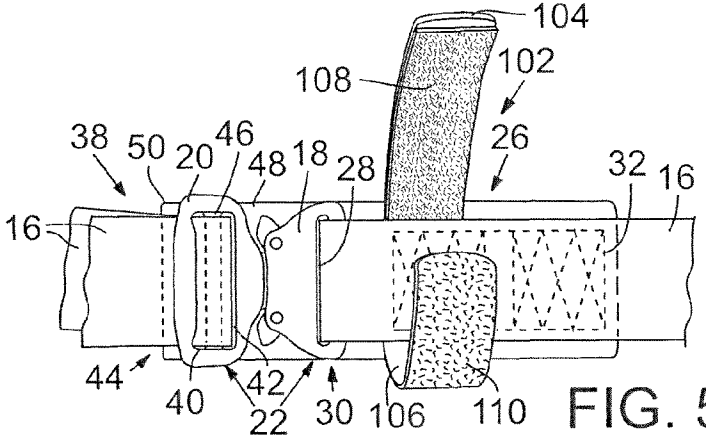
FIG. 5 is an enlarged partial top view of the litter strap assembly of FIG. 2 showing detail of a two-piece buckle, pinch guard, and storage band of the assembly.

A middle portion 34 of strap 16 disposed between first end portion 26 and an opposite second end portion 36 of strap 16 includes an adjustment section 38 slidably engaged with second buckle part 20 to permit manual adjustment of the size of securement loop 24. Adjustment section 38 is preferably threaded through a pair of parallel elongate slots 40 and 42 in second buckle part 20 and folded upon itself to form a second overfolded portion 44 that is wrapped around a friction bar 46 of second buckle part 20 interposed between slots 40 and 42. This overfolded threaded arrangement of adjustment section 38 forms a secure friction anchor connection to second buckle part 20 when strap 16 is under tension, to prevent securement loop 24 from loosening while allowing it to be tightened around person 12 by pulling on the free second end portion 36 of strap 16, as illustrated by the broken lines in FIG. 3 (and shown in tightened condition in FIG. 4). In some embodiments, a similar friction anchor connection may also be utilized at the connection between first end section 26 of strap 16 and first buckle part 18, in place of the non-adjustable connection shown in the drawings.

In one embodiment, a pinch guard 48 is affixed to first end portion 26 or first buckle part 18, by stitching 32 or otherwise. Pinch guard 48 extends from its point of attachment to first end portion 26 and past two-piece buckle 22 to thereby form a flap 50 that underlies (i.e. overlaps) substantially the entire two-piece buckle 22. Pinch guard 48 may, thus, prevent the skin or clothing of person 12 from being pinched between first and second buckle parts 18 and 20 when coupling them together. In some instances, pinch guard 48 may prevent pinching between adjustment section 38 and second buckle part 20 when adjusting the size of securement loop 24, as further described below with reference to FIGS. 6-9.

The free second end portion 36 of strap 16 is preferably securely attached to a keeper loop 52 that loosely encircles middle portion 34 of strap 16 for sliding movement therealong. Keeper loop 52 is moved along middle portion 34, away from second buckle part 20 and toward first buckle part 18, to take up slack in second end portion 36. When strap 16 is snugly cinched around person 12, the pressure of middle portion 34 against keeper loop 52 frictionally holds keeper loop 52 in place to retain second end portion 36 adjacent strap 16 and prevents second end portion 36 from flapping against the person 12 or attending medical personnel when exposed to helicopter rotor wash, high winds, or other perturbations. Retention of second end portion 36 by keeper loop 52 may also help prevent second end portion 36 from tripping emergency personnel, being tangled in equipment, or otherwise being mishandled.

Figure 6:
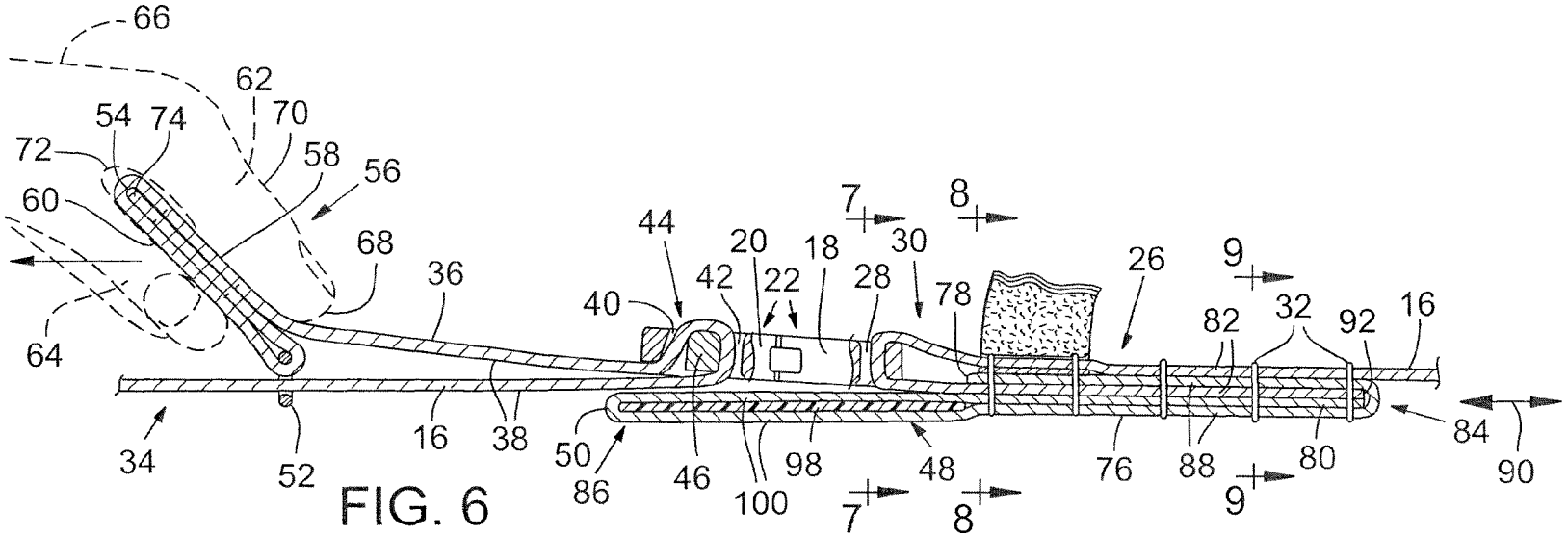
FIG. 6 is a partial longitudinal cross-section of the litter strap assembly of FIG. 3.
Figure 9:
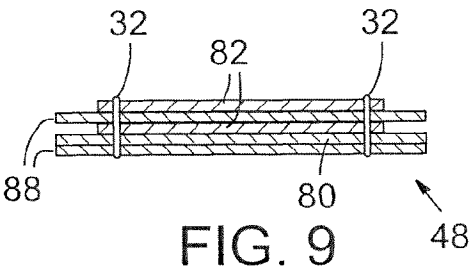
FIG. 9 is a lateral cross-section of the litter strap assembly of FIG. 2 taken along line 9-9 of FIG. 6.

A pull tab 54 may be formed by a third overfolded portion 56 of strap 16 where second end portion 36 is coupled to keeper loop 52. With reference to FIGS. 3 and 6, pull tab 54 comprises opposing top and bottom gripping surfaces 58 and 60 projecting from keeper loop 52 and preferably sized to accommodate the fingers 62 and thumb 64 of a user's hand 66. Pull tab 54 facilitates grasping and leverage for adjusting the position of keeper loop 52 along middle portion 34. While top gripping surface 58 is preferably sized to extend longitudinally from tip 68 of fingers 60 to middle knuckles 70, top gripping surface 58 may also be sized to extend to palm 72 of hand 62. In a preferred embodiment, second end portion 36 is folded upon itself twice to define third overfolded portion 56 and pull tab 54. This allows a cut end 74 of strap 16 to be sandwiched between sections of third overfolded portion 56 to prevent fraying of cut end 74 and abrasion of hand 62 during use. In addition, third overfolded portion 56 may be threaded through keeper loop 52 and secured to itself by stitching or otherwise. In another embodiment, pull tab 54 may be plastic, rubber, or another material stitched or otherwise secured to second end portion 36 or keeper loop 52.

Keeper loop 52 may be metal cast molded to form an endless loop or a segment of metal wire formed into a loop, the ends of which may or may not be joined by welding, for example. Examples of metal that may be used include steel, aluminum, and alloys. In addition, keeper loop 52 may be formed from other materials, such as plastic, and may take shapes other than the oval shape shown.

Referring now to FIGS. 5, 6, 7, 8, and 9, pinch guard 48 may be affixed to first end portion 26 so that pinch guard 48 substantially overlaps first buckle part 18 when first buckle part 18 is detached from second buckle part 20. In one embodiment, pinch guard 48 has a width greater than a width of strap 16 (FIG. 8) and is sized to substantially overlap both first buckle part 18 and second buckle part 20 when first buckle part 18 is coupled to second buckle part 20. This may not only prevent person 12 from being pinched as first buckle part 18 is attached to second buckle part 20, but may also prevent pinching as strap 16 moves through second buckle part 20 when adjusting the size of securement loop 24. By way of example, pinch guard 48 may be approximately 6.5 inches in length and approximately 2.25 inches in width, while strap 16 is approximately 1.625 inches in width and two-piece buckle 22 is approximately 2.25 inches in width. However, other lengths and widths may be used depending on the application.

In one embodiment, pinch guard 48 includes a second elongate strap 76 preferably made of a continuous elongate strip of fabric, such as woven nylon webbing. First and second ends 78 and 80 of strap 76 are typically heat cut, which may produce hard and sometimes sharp ends. To prevent fraying of ends 78 and 80 and abrading person 12 with ends 78 and 80, second strap 76 preferably has first end 78 interposed between overlapping portions 82 of overfolded first end section 30 of strap 16. In addition, second strap 76 is preferably folded upon itself twice to define axially opposite fourth and fifth overfolded portions 84 and 86 respectively. This allows second end 80 of strap 76 and a cut end 92 of strap 16 to be interposed between overlapping portions 88 of fourth overfolded portion 84. Fifth overfolded portion 86 may extend from first buckle part 18 past second buckle part 20 along axis 90 defined by the fourth and fifth overfolded portions 84 and 86 to prevent person 12 from being pinched when buckle parts 18 and 20 are coupled and when the size of securement loop 24 is adjusted.

Pinch guard 48 may be sewn to first end portion 26 of strap 16 using high-strength box stitches 32 (FIGS. 2 and 3). However, pinch guard 48 may be affixed to first end portion 26 or first buckle part 18 using another fastening mechanism. For example, rivets, snaps, epoxies, or other mechanisms or devices that join or affix two or more objects together may be used. In one embodiment, stitches 32 penetrate five layers of material (e.g., second end portion 80, overlapping portions 88 of fourth overfolded end portion 84, and overlapping portions 82 of overfolded first end section 30). The five layers of material form a relatively stiff assembly that keeps flap 50 of pinch guard 48 in position relative two-piece buckle 22. Stiffener 98 may be interposed between overlapping portions 100 of fifth overfolded end portion 86 so that stiffener 98 substantially overlaps two-piece buckle 22 when first buckle part 18 is coupled to second buckle part 20. Stiffener 98 may help prevent person 12 from being pinched when first buckle part 18 is attached to a second buckle part 20 by ensuring that flap 50 is properly positioned. In one embodiment, stiffener 98 extends to stitches 32 to ensure that stiffener 98 and pinch guard 48 remain in the proper position. However, stiffener 98 may be stuffed within a pocket formed by overlapping portions 100 of fifth overfolded end portion 86 or otherwise secured to pinch guard 48.

Figure 10:
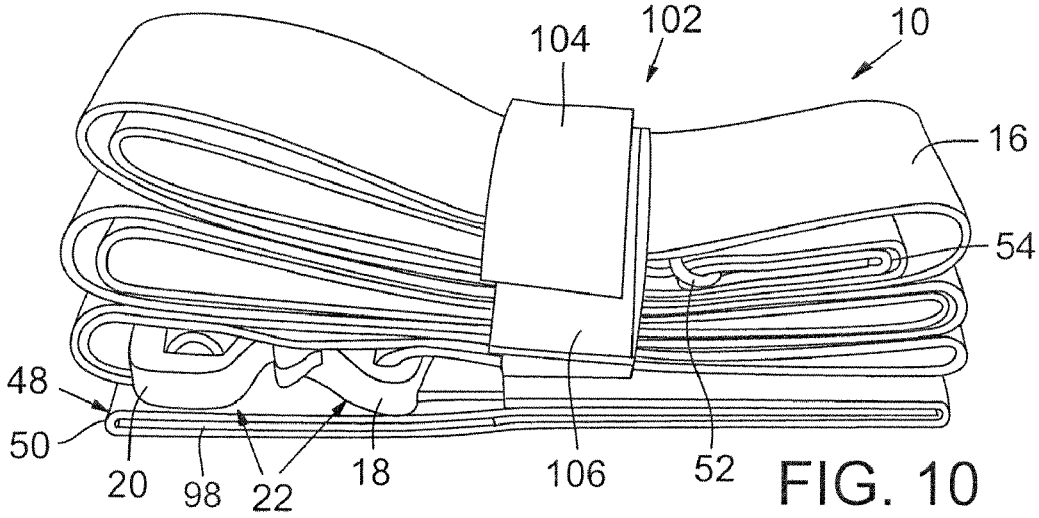
FIG. 10 is a perspective view of the litter strap assembly of FIG. 2 in a folded position for storage and secured by the storage band.
Figure 8:
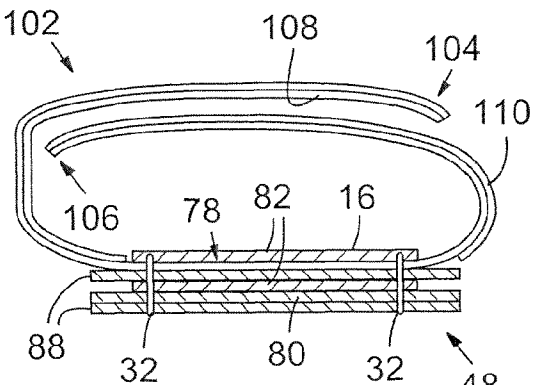
FIG. 8 is a lateral cross-section of the litter strap assembly of FIG. 2 taken along line 8-8 of FIG. 6.
Figure 7:
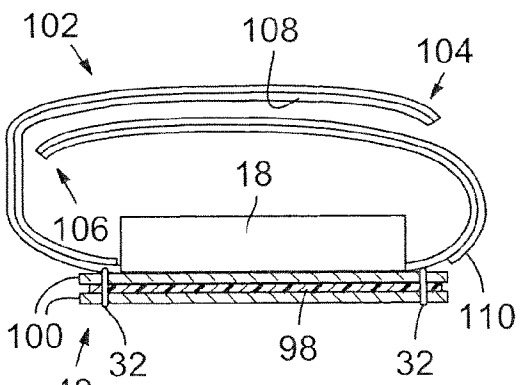
FIG. 7 is a lateral cross-section of the litter strap assembly of FIG. 2 taken along line 7-7 of FIG. 6.

Referring now to FIGS. 7, 8, and 10, storage band 102 may be affixed to first end portion 26 of strap 16 using any of the fasteners previously described with regard to pinch guard 48. Storage band 102 preferably has opposing first and second end portions 104 and 106 respectively extending laterally from strap 16. A first fastener 108 may be supported on first end portion 104 of storage band 102 and a second fastener 110 adapted to engage first fastener 108 may be supported on second end portion 106 of storage band 102. For example, a hook and loop type fastener, such as Velcro™ may be used. Alternatively other fasteners such as snaps or any of the fastening mechanisms previously described with regard to pinch guard 48 may be used to releasably connect first and second end portions 104 and 106 of storage band 102. Storage band 102 preferably has sufficient length to encircle and secure litter strap assembly 10 in a folded position for storage.

While strap 16 and second strap 76 may comprise nylon webbing, other webbing or fabric materials may be used. Further, while strap 16 and second strap 76 may each comprise a continuous length of material, segments of material may be combined to form strap 16 or second strap 76.

Litter strap assembly 10 has been described herein as being used with a litter. However, litter strap assembly 10 may also be used with other devices used to carry people, such as stretchers, scoop stretchers, reeves stretchers, gurneys, long spine boards, or wheelchairs, for example. In addition, litter strap assembly 10 may be used for securing other objects and cargo.

Various buckle types may be used for two-piece buckle 22, such as a three-way buckle, double bar buckle, swivel bar buckle, or others. In addition, first buckle part 18 and second buckle part 20 may be constructed from the same or different materials such as metal or plastic. One suitable two-piece buckle 22 is the Cobra buckle system sold by AustriAlpin Vertriebs GmbH of Fulpmes, Austria under part number FC45B. Further, while various examples have been described to secure overfolded first end section 30 to first buckle part 18, second overfolded portion 44 to second buckle part 20, and third overfolded end portion 56 to keeper loop 52, in some embodiments other securing methods may be used, such as riveting, stitching, overmolding, heat welding, bonding or otherwise.

It will be obvious to those having skill in the art that many changes may be made to the details of the above-described embodiments without departing from the underlying principles of the invention. The scope of the present invention should, therefore, be determined only by the following claims.

The invention claimed is:

1. An adjustable length litter strap assembly comprising:

a two-piece buckle including a first buckle part detachably coupled to a second buckle part, the first buckle part including an elongate slot, the second buckle part including two substantially parallel elongate slots;

an elongate strap for securing a person to a litter and sized to encircle the person and the litter, the strap having a first end portion secured to the first buckle part, a free second end portion opposite the first end portion, and an adjustment section therebetween, wherein the first end portion is folded upon itself to define a first overfolded end portion, the adjustment section is folded upon itself to define a second overfolded portion, the first overfolded end portion is threaded through the elongate slot of the first buckle part for securement thereto, and the second overfolded portion is threaded through the two substantially parallel elongate slots of the second buckle part and manually slidable therethrough for adjusting a length of the litter strap assembly; and a flexible pinch guard affixed to the first end portion so that the pinch guard substantially overlaps the first buckle part when the first buckle part is detached from the second buckle part, wherein the pinch guard has a width greater than a width of the strap, is sized to substantially overlap the first buckle part and second buckle part when the first buckle part is coupled to the second buckle part, and is not sized to encircle the person and the litter, whereby the flexible pinch guard protects the person from being pinched when the litter strap assembly encircles the person and the litter.

2. The litter strap assembly of claim 1 wherein the pinch guard includes an elongate second strap having a first end and a second end, the first end of the second strap interposed between overlapping portions of the first overfolded end portion, the second strap folded upon itself twice to define axially opposite third and fourth overfolded portions and so that the second end of the second strap is interposed between overlapping portions of the third overfolded portion, and the fourth overfolded portion extends from the first buckle part past the second buckle part along the axis defined by the third and forth overfolded portions, and the flexible pinch guard is stitched to the first end portion of the strap.

3. The litter strap assembly of claim 2 further comprising a stiffener interposed between overlapping portions of the fourth overfolded portion so that the stiffener substantially overlaps the two-piece buckle when the first buckle part is attached to the second buckle part.

4. The litter strap assembly of claim 2 wherein the second strap comprises a web of nylon.

5. The litter strap assembly of claim 1 wherein the strap comprises a web of nylon.

6. The litter strap assembly of claim 1 wherein the strap comprises woven fabric.

7. The litter strap assembly of claim 1 wherein the strap comprises a continuous length of webbing.

8. The litter strap assembly of claim 1 further comprising:

a storage band coupled to the first end portion, the storage band having opposing first and second end portions extending laterally from the strap;

a first fastener coupled to the first end portion of the storage band;

a second fastener coupled to the second end portion of the storage band, the second fastener adapted to engage the first fastener; and wherein the storage band has sufficient length to encircle and secure the litter strap assembly in a folded position for storage when the litter strap assembly is not positioned over the person and does not encircle the person and the litter.

9. The litter strap assembly of claim 8 wherein the storage band is interposed between overlapping portions of the first overfolded end portion.

10. The litter strap assembly of claim 1 wherein the pinch guard includes an elongate second strap affixed to the first end portion, the second strap folded upon itself to define a second overfolded portion and so that a first end of the second strap is interposed between overlapping portions of the second overfolded portion and a second end of the second strap is interposed between the first end portion and the second overfolded portion.

11. The litter strap assembly of claim 1 wherein the free second end portion is folded upon itself to define a pull tab.

12. The litter strap assembly of claim 11 wherein the free second end portion is folded upon itself twice to define the pull tab so that a cut end of the free second end portion is sandwiched between overlapping portions of the pull tab to thereby prevent fraying of the cut end.

13. The litter strap assembly of claim 1, further comprising:

a pull tab secured to the free second end portion, whereby the litter strap assembly can be tightened around the person by pulling the pull tab away from the second buckle part.

14. The litter strap assembly of claim 1 wherein the first overfolded end portion is secured to itself by stitching.

15. The litter strap assembly of claim 1 wherein the litter comprises a stretcher.

16. The litter strap assembly of claim 1 wherein the pinch guard includes a stiffener, the stiffener being sized to substantially overlap the first buckle part and second buckle part when the first buckle part is coupled to the second buckle part.

17. The litter strap assembly of claim 1 wherein for all adjustment positions of the litter strap assembly, the pinch guard substantially overlaps the first buckle part and second buckle part when the first buckle part is coupled to the second buckle part.

18. The litter strap assembly of claim 1 wherein the width of the pinch guard is approximately equal to a width of the two-piece buckle.

19. The litter strap assembly of claim 1 wherein a portion of the strap extending between the first and second buckle parts, when coupled, forms a securement loop adapted to encircle the person and the litter and a size of the securement loop is adjustable, via the adjustment section, to accommodate people of different sizes.

20. An adjustable length litter strap assembly comprising:

a two-piece buckle including a first buckle part detachably coupled to a second buckle part, the first buckle part including an elongate slot, the second buckle part including two substantially parallel elongate slots;

an elongate strap sized to encircle a person on a litter, the strap having a first end portion secured to the first buckle part, a free second end portion opposite the first end portion, and an adjustment section therebetween, wherein the first end portion is folded upon itself to define a first overfolded end portion, the adjustment section is folded upon itself to define a second overfolded portion, the first overfolded end portion is threaded through the elongate slot of the first buckle part for securement thereto, and the second overfolded portion is threaded through the two substantially parallel elongate slots of the second buckle part and manually slidable therethrough for adjusting a length of the litter strap assembly; and a flexible pinch guard including a stiffener, the pinch guard affixed to the first end portion so that the pinch guard and stiffener substantially overlap the first buckle part when the first buckle part is detached from the second buckle part, the pinch guard having a width greater than a width of the strap and the pinch guard and stiffener being sized to substantially overlap the first buckle part and second buckle part when the first buckle part is coupled to the second buckle part, whereby the flexible pinch guard protects the person from being pinched when the litter strap assembly encircles the person on the litter.

21. The litter strap assembly of claim 20 wherein the pinch guard is not sized to encircle the person on the litter.

22. The litter strap assembly of claim 20 wherein the pinch guard includes an elongate second strap affixed to the first end portion, the second strap folded upon itself to define a second overfolded portion and so that a first end of the second strap is interposed between overlapping portions of the second overfolded portion and a second end of the second strap is interposed between the first end portion and the second overfolded portion.

23. The litter strap assembly of claim 20 wherein the pinch guard includes an elongate second strap having a first end and a second end, the first end of the second strap interposed between overlapping portions of the first overfolded end portion, the second strap folded upon itself twice to define axially opposite third and fourth overfolded portions and so that the second end of the second strap is interposed between overlapping portions of the third overfolded portion, and the fourth overfolded portion extends from the first buckle part past the second buckle part along the axis defined by the third and forth overfolded portions, and the flexible pinch guard is stitched to the first end portion of the strap.

24. The litter strap assembly of claim 23 wherein the stiffener is interposed between overlapping portions of the fourth overfolded portion so that the stiffener substantially overlaps the two-piece buckle when the first buckle part is attached to the second buckle part.

25. The litter strap assembly of claim 20 wherein the strap comprises a web of nylon.

26. The litter strap assembly of claim 20 wherein the strap comprises woven fabric.

27. The litter strap assembly of claim 20 wherein the strap comprises a continuous length of webbing.

28. The litter strap assembly of claim 20 further comprising:

a storage band coupled to the first end portion, the storage band having opposing first and second end portions extending laterally from the strap;

a first fastener coupled to the first end portion of the storage band;

a second fastener coupled to the second end portion of the storage band, the second fastener adapted to engage the first fastener; and wherein the storage band has sufficient length to encircle and secure the litter strap assembly in a folded position for storage when the litter strap assembly is not positioned over the person and does not encircle the person on the litter.

29. The litter strap assembly of claim 28 wherein the storage band is interposed between overlapping portions of the first overfolded end portion.

30. The litter strap assembly of claim 20 wherein the free second end portion is folded upon itself to define a pull tab.

31. The litter strap assembly of claim 30 wherein the free second end portion is folded upon itself twice to define the pull tab so that a cut end of the free second end portion is sandwiched between overlapping portions of the pull tab to thereby prevent fraying of the cut end.

32. The litter strap assembly of claim 20, further comprising:

a pull tab secured to the free second end portion, whereby the litter strap assembly can be tightened around the person by pulling the pull tab away from the second buckle part.

33. The litter strap assembly of claim 20 wherein the first overfolded end portion is secured to itself by stitching.

34. The litter strap assembly of claim 20 wherein for all adjustment positions of the litter strap assembly, the pinch guard substantially overlaps the first buckle part and second buckle part when the first buckle part is coupled to the second buckle part.

35. The litter strap assembly of claim 20 wherein the width of the pinch guard is approximately equal to a width of the two-piece buckle.

36. The litter strap assembly of claim 20 wherein a portion of the strap extending between the first and second buckle parts, when coupled, forms a securement loop adapted to encircle the person and the litter and a size of the securement loop is adjustable, via the adjustment section, to accommodate people of different sizes.

* * * * *